United States Patent [19]

Michalak

[11] 4,083,124

[45] Apr. 11, 1978

[54] PROTECTIVE SHOE COVERINGS

[75] Inventor: Sylvia S. Michalak, South River, N.J.

[73] Assignee: Johnson & Johnson, New Brunswick, N.J.

[21] Appl. No.: 709,825

[22] Filed: Jul. 29, 1976

[51] Int. Cl.[2] ..... A43B 3/16

[52] U.S. Cl. ..... 36/7.1 R; 36/9 R

[58] Field of Search ..... 36/9 R, 9 A, 7.1 R, 36/7.3, 2 R, 109

[56] References Cited

U.S. PATENT DOCUMENTS

| | | | |
|---|---|---|---|
| 391,232 | 10/1888 | Dudley | 36/11 |
| 2,229,575 | 1/1941 | Kaplan | 36/7.1 R X |
| 3,148,378 | 9/1964 | Tibbitts | 36/9 R X |
| 3,798,503 | 3/1974 | Larsh et al. | 36/9 R X |
| 3,824,714 | 7/1974 | Glassman | 36/7.1 R |
| 3,871,027 | 3/1975 | Orr | 2/49 R |
| 3,979,776 | 9/1976 | Gruenwald | 2/49 R |

*Primary Examiner*—Alfred R. Guest

[57] ABSTRACT

A protective shoe covering of a single piece of flexible material having an upper section and heel, toe and sole covering portions with an opening in its upper section. The single piece of flexible material has a pair of opposed panels so joined together along sole, toe, and heel covering portions that the remaining upper section of the shoe covering is without seam, thereby providing improved bacteria and dust barrier properties.

9 Claims, 10 Drawing Figures

PROTECTIVE SHOE COVERINGS

BACKGROUND OF THE INVENTION

The present invention relates to sanitary protective foot and shoe coverings and more particularly to disposable sanitary protective coverings adapted to be used as shoe coverings.

Protective shoe coverings are employed for various purposes in hospitals and similar institutions where it is required that foreign matter from shoes be prevented from contaminating surrounding areas. One typical area where such products are extensively used is in operating rooms where the operating room personnel must prevent contamination of the room, equipment and other materials in the room from foreign matter carried by the shoes or boots of the personnel entering the room. In addition, such coverings also protect the foot wear, and in some instances, the lower portions of trousers and socks of the personnel from becoming soiled due to contact with, for example, soiled or contaminated operating room materials such as wet sponges, toweling, irrigating liquids, drippings and the like. Another application of protective shoe coverings is found in areas of patient isolation to prevent contamination of shoes and cross-contamination of patients. Furthermore, depending upon their particular use, the shoe coverings are also employed to dissipate or reduce the possibilty of generating static electricity between shoes worn by personnel and the floor surfaces; the latter requirement is essential when the foot wear coverings are employed in operating rooms where gaseous anesthetic mixtures are employed.

The art contains many proposed types and variations of foot or shoe coverings for the above purposes; typically, they are made of suitable flexible material providing the characteristics required for a particular use. In general, such disposable foot wear coverings well known in the art are comprised of several component parts which are assembled together by suitable means, and provided with suitable tying means added to the resulting product. Thus, such foot coverings are fabricated from an assemblage of several components, requiring several manufacturing steps to provide a completed product.

Foot coverings of a single or few components are taught in U.S. Pat. Nos. 3,824,714; 3,798,503 and 3,648,109, which illustrate disposable foot coverings of a single length of flexible material manufactured by a simple and economical process which eliminates extra manufacturing steps associated with foot coverings assembled from several component parts. However, although foot wear coverings made from a single piece of material have been taught, the fabrication of those shoe coverings include seams or stitches on the upper, front portion of the shoe coverings.

Notwithstanding their advantages, these foot wear coverings have not proven entirely satisfactorily under all conditions of service for the reason that bacteria and dust particles are able to penetrate at the seam or juncture of the component parts or at the seam or juncture of the panels in the case of a single piece of material, especially when the seam is located on the upper front portion of the covering.

Besides protective coverings for the shoes of the wearer, protective coverings in the form of low cut boots are also used by hospital and institution personnel. One typical protective boot is disclosed in U.S. Pat. No. 3,824,714. This boot covers the shoes of the wearer and encloses the trouser leg of the wearer so as to afford protection in those areas. Included on this boot and other typical boots is an electrically conductive tape to minimize static electricity build-up; tie string means are included on the upper portion of the boot to secure the upper portion snugly around the ankle of the wearer.

While tie string means are well known to secure both shoes and boots to the foot of the wearer, some problems have surfaced in their use. For instance, tie strings on protective boots may keep the boot flaps held around the leg of the wearer; however, due to loosening of the tie strings oftentimes the boot flaps do not remain up on the leg of the wearer, but tend to slide down. When this happens, the trousers and/or socks of the wearer become exposed to contaminated operating room materials.

SUMMARY OF THE INVENTION

In accordance with the present invention there is provided an improved shoe covering which is fabricated from a single length or piece of flexible material. The new shoe covering is simple and economical to manufacture; easy to put on and remove; and may be provided with elastic means to tightly seal the shoe of the wearer from the outside environment.

The footwear of the present invention, whether a shoe covering or a boot for covering the shoes and trousers of the wearer, provides a number of advantages which have been lacking in the prior art. The seamfree front of the footwear of this invention reduces the chance of contamination of the room and protects the footwear from coming into contact with soiled or contaminated operating materials, for example, wet towels, irrigating liquids, etc. In accordance with one aspect of the invention, a protective shoe cover is made from a single piece of flexible material. The flexible material has a pair of opposed panels joined together along a substantial portion of the edges of the panels to define a shoe-shaped enclosure with an opening in the upper section of the enclosure for receiving a shoe of the wearer. To form the shoe-shaped enclosure the edges of the panels are joined at the heel, sole and toe covering portions, thereby providing a seam in those portions. Included in the enclosure is an upper portion with an opening being formed by the free, unjoined edges of the panels. The remaining upper portion of the shoe covering between the opening and the toe covering portion is a section of the flexible material which is completely free of a seam.

Another advantage of this invention is that these shoe coverings may employ a conductive strip which is attached flat to the sole covering portion of the shoe covering to ensure comfort and reduce the hazard of static electricity building up in the body of the wearer in attendance during hospital surgery.

A further advantage in the footwear of this invention is provided by the use of an elastic means around the foot-receiving opening in preferred embodiments of the shoe covering. The elastic holds the covering securely on the shoe of the wearer while preventing the covering from slipping off during use.

In accordance with another aspect of the present invention, a new protective covering for the trousers and lower leg of the wearer in the form of a flexible boot has been discovered. When embodiments of the shoe-shaped bottom portion of the boot are constructed of a single piece of material with no seam on the front portion, the boot will have all the aforementioned advantages of the shoe covering. The boot of the present invention has means which prevents the boot from sliding down the trousers after the upper section of the boot has been secured around and fastened to the leg of the wearer. This advantage insures the comfort and safety of the wearer and reduces contamination and cross-contamination of patients and the users in areas of the operating room clean air rooms, etc.

These advantages are accomplished in the present instance by providing a boot for covering a shoe and the lower leg of a wearer including a lower section of a flexible material in the form of a shoe-shaped enclosure with an opening for receiving the shoe or foot of the wearer. An upper section of flexible material is joined to the lower section substantially around the opening and extending in an upward direction from the opening to form a covering for encircling the lower leg of the wearer. The material of the upper section includes an inside surface and an outside surface. Adhesive means are located on the inside surface of the upper section for adhesively fastening the upper section to the leg or trousers of the wearer whereby in use, the booot is prevented from sliding down from the trousers.

In the preferred embodiment of the boot of the present invention, a conductive strip is attached to the lower section and is placed inside the boot to ensure that the wearer is protected against electrical charges. The preferred embodiment also includes a collar joining the upper and lower sections of the boot including elastic means for securing the lower section on the shoe of the wearer, the elastic producing a good fit and improving the appearance of the product, while reducing the chances of the trousers slipping out.

The footwear covering of the present invention conform to the shoe of the wearer due to the configuration of flat sole, round toe and collar means around the opening through which the foot of the wearer is inserted. This snug fit provides for comfortable movements of the wearer without the danger of tripping.

BRIEF DESCRIPTION OF THE DRAWINGS

These and other advantages, features and aspects of the invention will become apparent upon reading the following detailed description and upon reference to the accompanying drawings wherein.

While the invention will be described in connection with a preferred embodiment, it will be understood that it is not intended to limit the invention to that embodiment. On the contrary, it is intended to cover all alternatives, modifications and equivalents as may be included within the spirit and scope of the described invention.

DETAILED DESCRIPTION OF THE INVENTION

Figure 1:
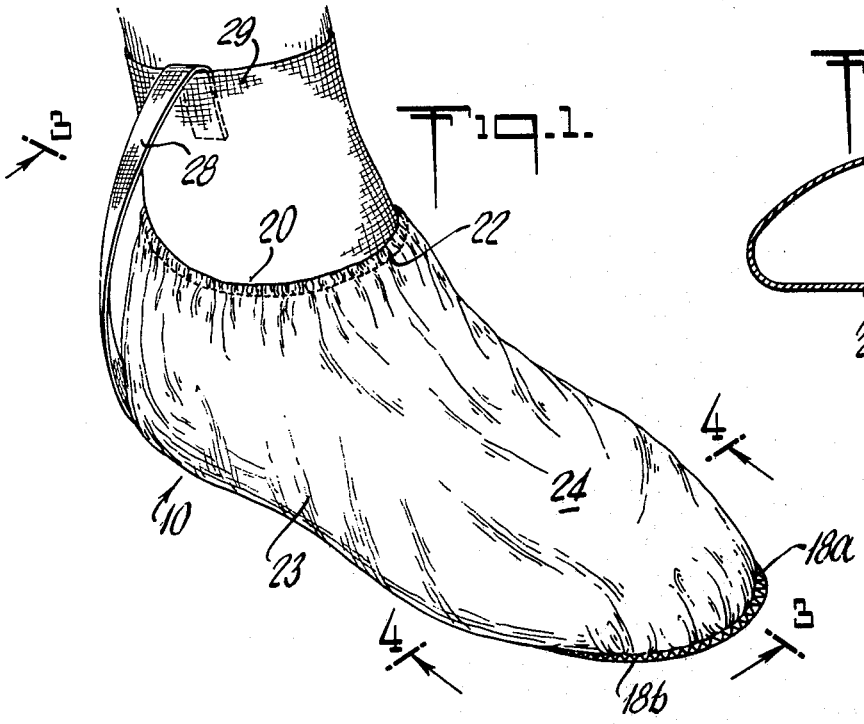
FIG. 1 is a perspective view of the product according to the present invention shown covering the shoe of the wearer.
Figure 2:
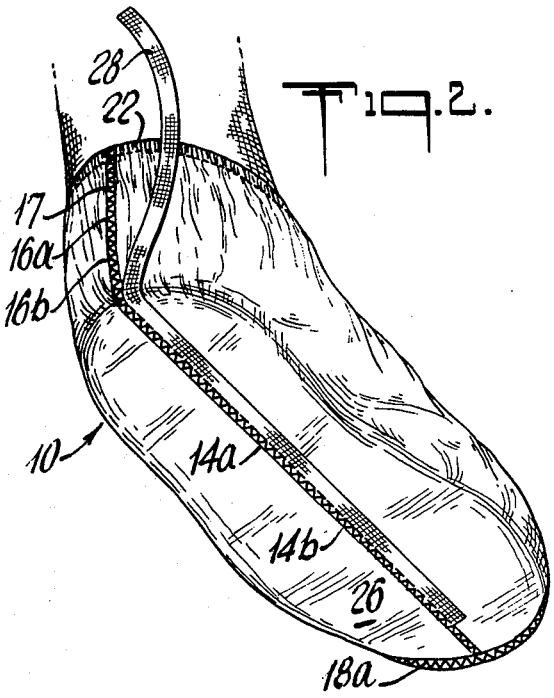
FIG. 2 is a bottom perspective view of the product secured on a shoe.

Referring to the drawings, there is shown in FIGS. 1 to 4 the preferred embodiment of the protective foot wear covering of the present invention, generally designated 10. As shown in FIGS. 1 and 2, the protective footwear covering fits over the shoe of the wearer. In this instance, the product illustrated is adapted to be used as an operating room foot wear covering, to prevent contamination from a shoe or a foot, to prevent soiling of the users foot apparel, and to provide grouning means to prevent the build-up of static electricity.

Figure 5:
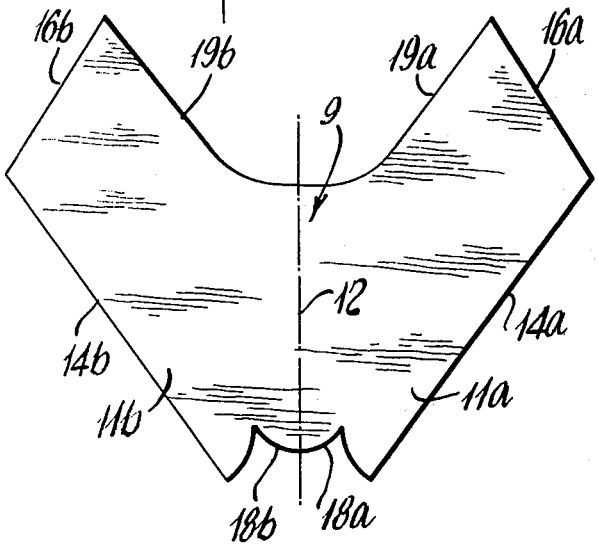
FIG. 5 is a plan view of a blank from which the shoe cover of FIGS. 1 to 4 is constructed.

As illustrated more clearly in the embodiment of FIG. 5, shoe cover 10 is made from a single piece of flexible material or blank 9, such as a polyethylene film backed nonwoven fabric, with a thickness of approximately 0.003 inch (0.0076 cm.) Blank 9 comprises a pair of opposed panels indicated by reference numerals 11*a* and 11*b*, which, in a layflat condition, are of a substantially identical configuration. Panels 11*a* and 11*b*, are joined to each other along center line 12 of blank 9. Desirably, the panels 11*a* and 11*b* are integrally joined at the center 12 of a single piece of material or blank 9. The free margins of panels 11*a* and 11*b* form sole covering portions 14*a* and 14*b*, heel covering portions 16*a* and 16*b*, toe covering portions 18*a* and 18*b*, and free edge or margin portions 19*a* and 19*b* which, in the finished product cooperate to form a foot or shoe-receiving opening 20 into which the wearer inserts his foot. A length of elastic material 22 is attached to the free edge or margin portion 19*a* and 19*b* around the opening 20. This elastic material secures and holds the shoe covering against the foot of the wearer to retain the covering on the shoe.

Figure 4:
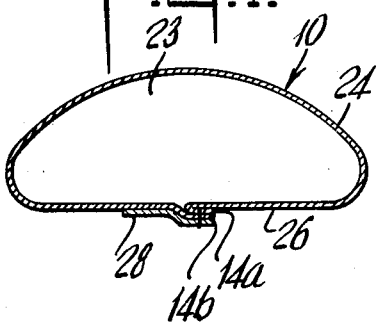
FIG. 4 is a section taken along line 4—4 of FIG. 1.

Any suitable means for securing the sole covering portions 14*a* and 14*b*, the heel covering portions 16*a* and 16*b*, and the toe covering portions 18*a* and 18*b* respectively, toegther may be employed; for example, the edges of the respective cover portion may be stitched, heat sealed when thermosplastic materials are use, glued and the like. The preferred embodiment illustrated in the drawings utilizes stitching, the seams of the joined portions being evident. In the finished product depicted in the drawings the portions of the panels which are joined define a shoe-shaped enclosure 23. Panels 11*a* and 11*b* form an upper portion 24 of the enclosure 23 which is without any seams in the area between the opening 20 and the toe covering portion 18*a* and 18*b*. The absence of the seam provides a better barrier against contamination between the surrounding and the shoe of the wearer. This upper portion of the footwear covering 10 generally assumes the contour of the wearer's foot or shoe. The sole covering portion 26 of the footwear covering 10 is generally flat as best illustrated in FIG. 4. It is to be noted that the seams where the panels of the enclosure 23 are joined together are positioned under the sole and behind the heel of the shoe, thereby greatly reducing the possibility of cross-contamination between the shoe of the wearer and the environment. The front of the upper portion 24 of the footwear covering 10 is joined along toe covering portion 18*a* and 18*b*, the contour of which is substantially round as best shown in FIG. 1. Thus, toe covering portion 18*a* and 18*b* will, when the footwear covering is in use, provide a contour conforming generally to the shoe. While the round toe accommodates most shoe styles, other configurations, such as, for example, a square configuration, may also be utilized for the toe covering portion.

Figure 3:
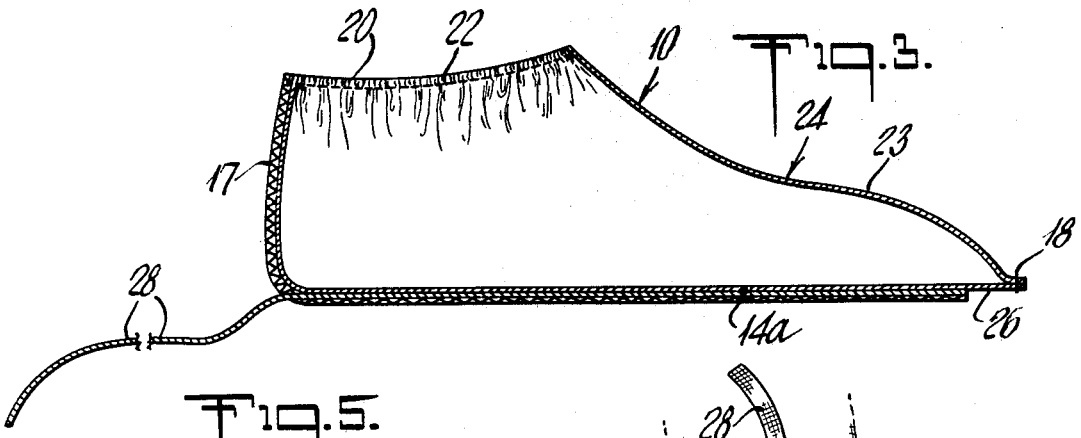
FIG. 3 is a section taken along line 3—3 of FIG. 1.

In keeping with the invention the opening 20 is located in the upper portion 24 of the enclosure 23, generally adjacent the heel covering portion 17, as best seen in FIG. 3. The remaining upper portion between the opening 20 and the toe covering portion 18*a* and 18*b* is a section of the flexible material of the enclosure 23 which is free of any seams.

Further, in accordance with the invention the foot covering, when intended for operating room use, preferably is fabricated from a suitable anti-static material, or in the alternative, includes an anti-static strip 28. The inclusion of the anti-static strip 28 is to provide a means to ground the wearer and prevent static electricity build-up, and is included in accordance with conventional techniques and practices. As indicated, the strip 28 may be of any suitable material inherently or rendered electrically antistatic and secured to the shoe covering in a conventional location to perform its function. Generally, the strip 28 is secured to the sole covering area 26 of the shoe covering, leaving a free end portion as shown in FIG. 3 which may then be tucked inside the footwear covering or inside the sock 29 of the wearer when in use as seen in the drawings.

Figure 6:
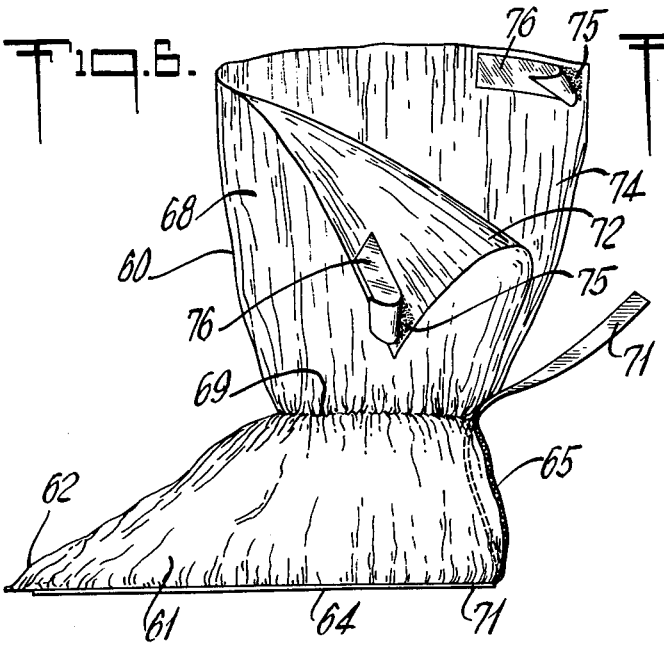
FIG. 6 is a side elevation view showing the preferred embodiment of the protective boot covering.
Figure 7:
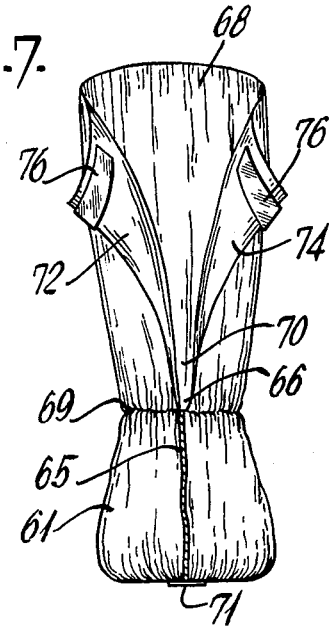
FIG. 7 is a rear elevation view showing the boot of FIG. 6.

The preferred footwear covering of the present invention which also protects the lower leg or trousers of the wearer is depicted in FIGS. 6 and 7. This preferred footwear is a boot 60 with a lower section 61 made of flexible material in the form of a shoe-shaped enclosure. The shoe-shaped enclosure has a toe covering portion 62, a sole covering portion 64 and a heel covering portion 65 and also foot-receiving opening 66 into which the shoe or foot of the wearer is inserted. In the preferred form the lower, shoe-shaped section is the same or similar covering as defined in FIGS. 1 to 4 of the invention, namely, being constructed of a single length of flexible material while having no seams on the upper front portion thereof. While this shoe-shaped section is preferred, any flexible shoe-shaped material will suffice as the lower section of the boot, including those shoe-shaped sections or enclosures with multiple components such as separate upper portions and sole portions stitched around the periphery of the sole portion.

The boot 60 also includes an upper section 68 of flexible material joined to the lower section 61 substantially around the opening 66. In one form the upper section 68 and the lower section 61 may be formed from one piece of material so that the respective sections are integral in nature. However, where economical and practical the upper and lower sections are separate pieces joined together by stitching, gluing, etc. It is often desirable to include a collar at the point where the upper and lower sections are joined, so that the boot can be secured to the shoe of the wearer without slipping off. The collar 69 may be a gathering of the material by stitching or the like in order to provide some means of preventing the shoe portion from slipping off during use. Preferably, however, the collar 69 includes an elastic which provides the means to secure the lower, shoe-shaped section 61 of the shoe on the wearer's foot.

While joined to the lower section around its opening, the upper section 68 has flexible material extending in an upward direction to form a covering for encircling the lower leg of the wearer. In the particular boot illustrated the upper section 68 extends upwardly from the opening 66 so that two opposing wrappable flap segments 72 and 74 of the flexible material of the upper section 68 are formed. A gap 70 or break in the material separates the flaps 72 and 74 so that subsequent overlapping of the flaps can take place during use by the wearer.

Located on flaps 72 and 74 of this embodiment are adhesive areas 75. The adhesive area 75 is positioned on the inside surface of the flaps so that the adhesive surface can be pressed against either the leg of the wearer or, preferably, the trousers of the wearer during use. Use of the adhesive attachment means will provide not only a technique for holding the upper section 68 around the leg of the wearer, but also a sufficient means for holding the upper section in place without subsequent sliding down. Any well known pressure-sensitive adhesive may be used to satisfy the requirements of this invention. While both flaps are shown with adhesive areas in the attached illustration, it is only essential that one flap have adhesive on the inside surface since other fastening means may be associated with the outside surface of the first flap or the inside surface of the second flap to secure the second flap in place as will hereinafter be described.

To protect the pressure-sensitive adhesive during storage, shipping and before use it is desirable to cover the adhesive 75 with a protective release sheet 76. Release sheets to protect adhesive areas are well known, and may be selected accordingly to perform the function indicated. When the boot is ready for use, the wearer simply peels the protective release sheet from the adhesive area thereby exposing the adhesive which is to perform the fastening.

Since these boots are generally worn in operating areas with explosive gaseous atmospheres, it is further desirable to include an anti-static strip 71 on the boot. The strip 71 is attached to the sole covering portion 64 of the lower section 61 and, in the embodiment shown, is sewn so that it extends inside the heel covering portion 65 of the lower section. By being sewn inside, the anti-static strip is in ready position to be tucked in the shoe or the sock of the wearer to prevent undesirable static electricity build-up. Of course, the anti-static strip 71 may be sewn so that it extends outside the lower section of the boot, as long as it is made long enough to be tucked inside the shoe or the sock of the wearer.

Figure 8:
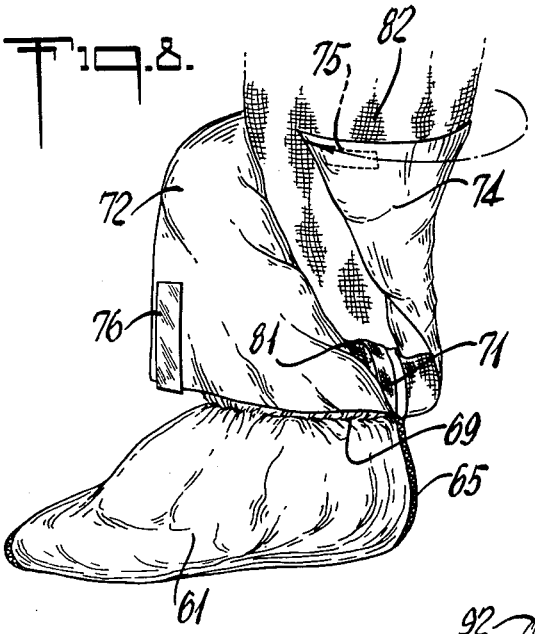
FIG. 8 is a side perspective view showing the attachment of one adhesive flap to the lower leg of the wearer.
Figure 9:
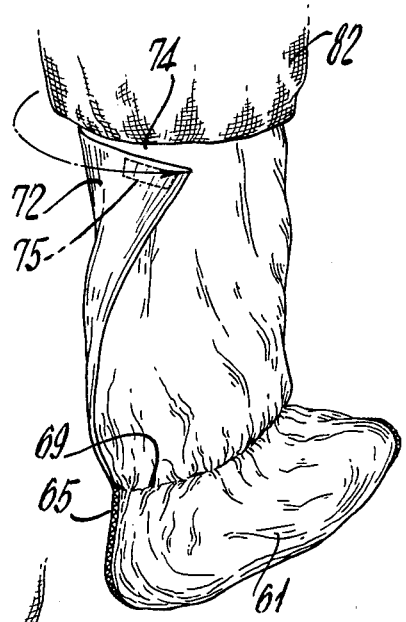
FIG. 9 is a rear perspective view showing the attachment of the second adhesive flap in position to hold the boot in place.
Figure 10:
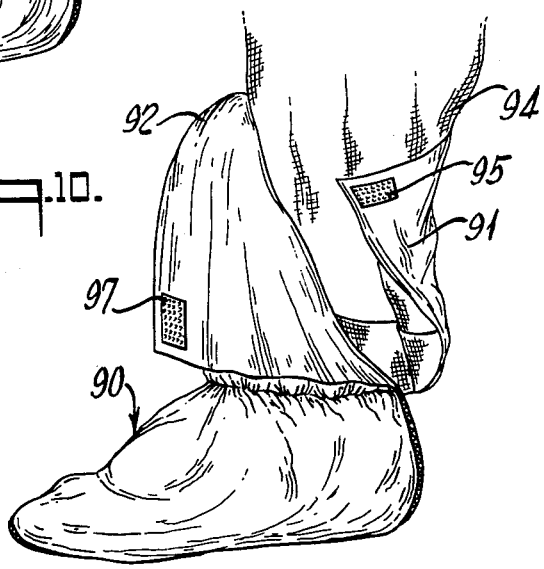
FIG. 10 is a side perspective view showing the flaps with another embodiment for fastening around the lower leg.

FIGS. 8, 9 and 10 show the boot on the shoe of the wearer and the technique of securing the upper section of the boot to the trousers of the wearer to prevent the boot from sliding down. In the worn position the lower section 61 encloses the shoe of the wearer and is held securely on that shoe by means of the collar 69. At this time, before securing the upper flaps, the wearer conveniently tucks the anti-static strip 71 into his shoe or sock 81 in order to effect the proper static grounding. As best seen in FIG. 8, the adhesive area on one upper extending flap 74 is exposed, the flap is wrapped around the lower leg, and the adhesive is pressed against the wearer's trousers to make an adhesive fastening. This fastening secures the flap 74 against the trousers 82 so that the upper section will not slide down the trousers 82 of the wearer.

After wrapping the first flap 74 and adhesively securing that flap to the trousers, the wearer exposes the adhesive area on the other flap 72 by removing the protective release sheet 76 from the adhesive area, and wraps flap 72 around the lower leg and over the first flap 74. FIG. 9 shows the two flaps wrapped around the leg or trousers of the wearer in the completely fastened position. It can be seen that one of the two flaps (e.g., flap 74 in the illustrations) is adhesively fastened to the trousers 82 of the wearer; the second of the two flaps (e.g., flap 72 in the illustrations) partially overlaps, and is adhesively fastened to the outside surface of the first flap 74. This overlapping of the flaps not only secures the boot to the leg of the wearer, and prohibits the boot from sliding down, but also effectively covers the entire lower portion of the leg so as to reduce contamination while protecting the lower leg of the wearer from contact with contaminated materials.

Instead of an embodiment in which both flaps have an adhesive area on the inside surface of the flap, other means of securing the second flap to the first flap may be utilized. For instance, in FIG. 10 there is shown an embodiment of a boot 90 in which a first flap 91 of the upper section 92 includes an adhesive area on the inside surface thereof; in FIG. 10 the adhesive on the first flap is not seen since the flap 91 has been pressed and adhesively fastened to the trousers 94 of the wearer.

On the outside surface of first flap 91 is a fastening means 95, such as a pressure-sensitive adhesive. With the pressure-sensitive adhesive 95 on the outside surface of first flap 91 no adhesive means is required on the second flap 97; secured flap 97 merely needs to be wrapped over and around the outside surface of first flap 91 in order to be receptive to the pressure-sensitive adhesive means 95 located thereon, thereby providing a fastening of the second flap.

Of course, fastening means 95 on the outside surface of first flap 91 is not restricted to pressure-sensitive adhesives. Other fastening techniques, such as the "VELCRO" type system may suitably be employed. When using the "VELCRO" type system, the fastening means 95 on the first flap may be, e.g., the male portion of the system, and on the inside surface of second flap 97, there is located, e.g., the female portion of the "VELCRO" fastener 98. This system is used in conjunction with adhesive fastening means on the inside surface of first flap 91. Other fastening means to perform the above-described function may also be used.

The footwear coverings of the present invention may by made from any suitable material having sufficient flexibility to permit conformity of the material to the footwear being worn. Such materials, include, by way of example, woven and nonwoven fabrics of thermoplastic fibers, cellulosics, and the like, resin coated woven and nonwoven fabrics as well as resin coated papers, and the like. By way of specific example, the preferable materials for forming the footwear coverings include nonwoven fabrics of natural or synthetic fibers or blends thereof, particularly mixtures of rayon and similar fibers with pulp fibers, resinous fiber materials such as those made of polyolefins (polyethylene) and copolymers of ethylene with other comonomers; polypropylene and copolymers thereof; polyvinylchlorice, etc. and resin coated paper and the like. Laminates of resinous films and wovens or nonwoven fibers and laminates of resinous films and paper products are also suitable materials for the present invention. The size, type, thickness, stiffness and other characteristics of the material must be selected, however, to fulfill the requirement that the material possess sufficient flexibility to conform to the outline of the shoe or similar article of footwear in use.

Any particular material chosen may have additional characterisitics included therein or imparted thereto by various additive treatments. For instance, moisture resistance may be provided to the material of the shoe covering by treating the material with a water-repellent agent. In the case of footwear covering for hospital use, such as in operating rooms, the preferred materials are resin coated nonwoven fabrics, such as polyethylene-coated fabrics, which provide dust impermeability and moisture resistance.

In still other forms of the footwear coverings of the present invention, other materials such as metallized plastic or fabric materials may be employed, or in still other cases, various types of metallic foils, such as aluminum and tin may be suitably formed into the foot coverings of the present invention. Such materials find application in various fields of use where the properties imparted to the covering by the metallic components are required.

The foot covering products of the present invention may be made in any desirable size and proportion to accomodate varying shoe or foot sizes for the intended users. However, for most purposes, a single size has been found to be sufficient for most types of shoe coverings, due to the nature of the products of the present invention.

The shoe coverings of the invention may be made by any suitable method known in the art. In general, a single length of flexible material is folded and cut to the desired shape by using a suitable die or other means. The specific manner of cutting will depend upon the type of material required. In the case of thermoplastic or other similar resins, these may be die-cut by suitable apparatus. For a continuous operation, the cutting may be carried out in a continuous-in-line formation technique by folding the material, feeding the folded material through a rotating cutter and subsequently discharging the cut shoe covering lengths or portions to a subsequent sealing operation.

Thus, it is apparent that there has been provided, in accordance with the invention, protective coverings that fully satisfy the aims, advantages and aspects set forth above. While the invention has been described in conjunction with specific embodiments thereof, it is evident that many alternatives, modifications and variations will be apparent to those skilled in the art in view of the foregoing description. Accordingly the complete invention is intended to embrace all such alternatives, modifications and variations as fall within the spirit and broad scope of the described invention.

What is claimed is:

1. A boot for covering a shoe and the lower leg of a wearer comprising: a shoe-shaped lower section of flexible material having a foot-receiving opening therein; an upper section of flexible material joined to said lower section substantially around the opening thereof and extending in an upward direction from said opening to form a covering for encircling the lower leg of the wearer, said upper extending section including two opposing wrappable flap segments of said flexible material, each of said flap segments having an inside surface and an outside surface; and adhesvie means located on the inside surface of at least one of said flaps whereby when used, the flap with said adhesive means thereon is wrapped around the leg or trousers of the wearer and adhesively fastened thereto.

2. A boot as defined in claim 1 wherein adhesive means is located on the inside surface of each flap segment whereby, when used, one flap is wrapped around the leg or trousers of the wearer and is adhesively fastened thereto, and the other flap is wrapped around the lower leg or trousers of the wearer and said first flap, and is adhesively fastened to said first flap.

3. A boot as defined in claim 1 further comprising means on the outside surface of the first of said flaps to fasten the second of said flaps in place when said second flap is wrapped around the leg of the wearer and said first flap.

4. A boot as defined in claim 1 which further comprises a conductive anti-static strip attached to said lower section.

5. A boot as defined in claim 4 wherein the conductive anti-static strip is attached to the sole portion of the lower, shoe-shaped section.

6. A boot as defined in claim 1 wherein the upper section of material is integral with the lower section of material.

7. A boot as defined in claim 1 wherein the flexible materials of the upper and lower section are selected from the group consisting of woven, nonwoven, film, resin-coated woven and nonwoven, laminate of resinous film and woven, laminate of resinous film and nonwoven, laminate of resinous film and paper, and metal foil materials.

8. A boot as defined in claim 1 wherein the flexible material is a laminate of resinous film and nonwoven materials, said upper and lower sections being joined at a collar including elastic means for securing said lower section on the shoe of the wearer, said boot further comprising a conductive anti-static strip attached to the sole portion of the lower, shoe-shaped section.

9. A boot as defined in claim 1 wherein the flexible materials of said upper and said lower sections are moisture resistant.

* * * * *